United States Patent [19]

Phillips et al.

[11] Patent Number: 5,032,037

[45] Date of Patent: Jul. 16, 1991

[54] METHOD AND APPARATUS FOR TEMPORARY MATTING FOR USE AT CONSTRUCTION SITES

[76] Inventors: Mark L. Phillips, 108 Tanglewood Dr., Lafayette, La. 70503; Raymond R. Thibodeaux, 125 Pembroke La., Lafayette, La. 70508

[21] Appl. No.: 509,059

[22] Filed: Apr. 12, 1990

[51] Int. Cl.[5] ..... E01C 5/14

[52] U.S. Cl. ..... 404/73; 404/35; 404/46

[58] Field of Search ..... 404/35, 36, 41, 46, 404/73; 52/578, 580, 581, 592

[56] References Cited

U.S. PATENT DOCUMENTS

| | | | |
|---|---|---|---|
| 1,935,823 | 11/1933 | Turner | 404/46 |
| 2,652,753 | 9/1953 | Smith . | |
| 2,819,026 | 1/1958 | Leyendecker . | |
| 2,912,909 | 11/1959 | Hart . | |
| 4,289,420 | 9/1981 | Davis et al. | 404/35 |
| 4,462,712 | 7/1984 | Penland, Sr. | 404/46 X |
| 4,600,336 | 7/1986 | Walker, Jr. | 404/35 |
| 4,600,337 | 7/1986 | Sarver | 404/35 |
| 4,875,800 | 10/1989 | Hicks | 404/35 |
| 4,889,444 | 12/1989 | Pouyer | 404/36 X |
| 4,973,193 | 11/1990 | Watson et al. | 404/41 X |

FOREIGN PATENT DOCUMENTS

| | | | |
|---|---|---|---|
| 247649 | 10/1989 | Japan | 52/578 |

*Primary Examiner*—Ramon S. Britts
*Assistant Examiner*—David J. Bagnell
*Attorney, Agent, or Firm*—William W. Stagg

[57] ABSTRACT

A three ply mat and matting system for constructing temporary access roads and work surfaces over areas of poor soil conditions. The mats comprise upper and lower layers of longitudinally offset wooden boards separated by an intermediate layer of transverse boards. The upper and lower offsets form opposing upper and lower L-shaped lips with the addition of intermediate transverse boards at the edges of each offset. The mats are joined together to form an easily removable matting system by overlaying a plurality of identical mats, upper L-shaped lip over lower L-shaped lip, to form the mat system over the area to be covered.

13 Claims, 2 Drawing Sheets

METHOD AND APPARATUS FOR TEMPORARY MATTING FOR USE AT CONSTRUCTION SITES

FIELD OF THE INVENTION

The present invention relates to temporary construction access mats and matting systems and, more particularly, presents a new and improved matting method and apparatus for use in building temporary roads and work surface areas at construction sites with poor soil conditions with increased efficiency in the installation and removal of the roads and work surfaces.

BACKGROUND OF THE INVENTION

Wooden mats have been utilized in the oil and gas industry and the construction industry to provide temporary access roads to construction sites that are otherwise generally inaccessible to heavy trucks and construction equipment because of poor soil conditions. These mats provide access to the construction site for location of drilling rigs and other heavy construction equipment during the drilling and construction phase of operations. When drilling or construction is completed these mats can be removed for utilization elsewhere.

Conventional mats for temporary access roads are constructed of wooden boards. They can be built piece by piece or by use of a plurality of prefabricated mats tied together. Fitting together individual mats that have horizontally projecting interlocking tabs and slots has been the conventional method of tying the prefabricated mats together to form an access road. Individual mats are linked together, tab into slot, to form the matting system.

Waller, Jr., U.S. Pat. No. 4,600,336 discloses an interlocking wooden mat assembly with selected planks on the top layer of the mat projecting from the edge to provide a male extension to couple with a corresponding female recess on an adjoining mat.

Penland, Sr., U.S. Pat. No. 4,462,712 discloses a similar flooring system with a plurality of interlocking mats, the mats are locked together by protruding tabs or extensions fitting into corresponding recesses on adjacent mats.

Other methods of matting have been disclosed by Hicks, U.S. Pat. No. 4,875,800 and Pouyer, U.S. Pat. No. 4,889,444. Both disclose a mat and matting method where multiple layers of two-ply mats are laid down and are then secured with a second layer of two-ply mats to lock the system in place.

Conventional mats and matting methods that employ tabs experience the problem of the tabs being broken off during construction or removal and storage. This causes fitting problems on reuse so that maintenance is required to replace the broken tabs before the mats can be reused. The other methods, like Hicks and Pouyer, require laying down the individual mats in a series of layers in order to achieve the locking effect and in order to provide sufficient strength to the mat system. This increases the labor and time involved in installation and removal and therefore the costs of the temporary road.

There has been a need for a temporary matting apparatus and method of construction that eliminates or minimizes the effects of broken tabs or extensions that is present in conventional mats and, at the same time, eliminates the time, cost and expense of laying down the mats in multiple layers to ensure an interlocked mat of sufficient strength.

SUMMARY OF THE INVENTION

The present invention provides a method and apparatus for temporary matting for use at construction sites to satisfy the aforementioned needs. It is comprised of a plurality of three ply mats of rectangular configuration that interlock by way of lips at opposite ends of each mat. The upper and lower bearing layers of each mat are comprised of longitudinal boards set side by side to form a uniform bearing surface. The inner layer is comprised of a plurality of boards placed transversely to the longitudinal boards of the upper and lower layers.

The boards of upper and lower layers of each mat are offset with respect to each other and are tied together by the transverse boards of the inner layer. The offsets are coupled with upper and lower transverse end boards in a manner so as to form upper and lower lips at opposite ends of the mat.

A temporary road or work surface is constructed with a plurality of the mats having upper and lower lips at opposite ends. The temporary road is started by using a fork-lift, crane or other lifting means of lay down on the ground to be covered a single mat to expose the mat's lower lip. A second mat is laid down with the upper lip of the second mat over the lower lip of the first mat and thereby tying the two mats together to form a unit. Any number of additional mats can be put together in a similar fashion to form a road or work surface. The width of the road or work surface can be expanded simply by adding additional rows of abutting mats. The interlocking upper and lower lips hold adjoining mats together without the use of nails or other fastening means and aid in the transfer of bearing loads from one mat to the next.

Thus, this new and improved mat and matting system eliminates the need for male and female tabs and inserts which can be broken during the construction and removal of the mats and the corresponding maintenance associated with those problems. The inventor also provides a method for constructing in one operation a three ply interlocked mat system without nails or other fastening means. This allows a reduction in the cost, the labor and the time associated with mat installation and removal. Consequently, the present invention relates to a new and improved apparatus and method for temporary matting for use at construction sites which comprises a mat of unique shape and design and provides a method of construction that solves the aforementioned needs.

DESCRIPTION OF THE PREFERRED EMBODIMENT(S)

Figure 1:
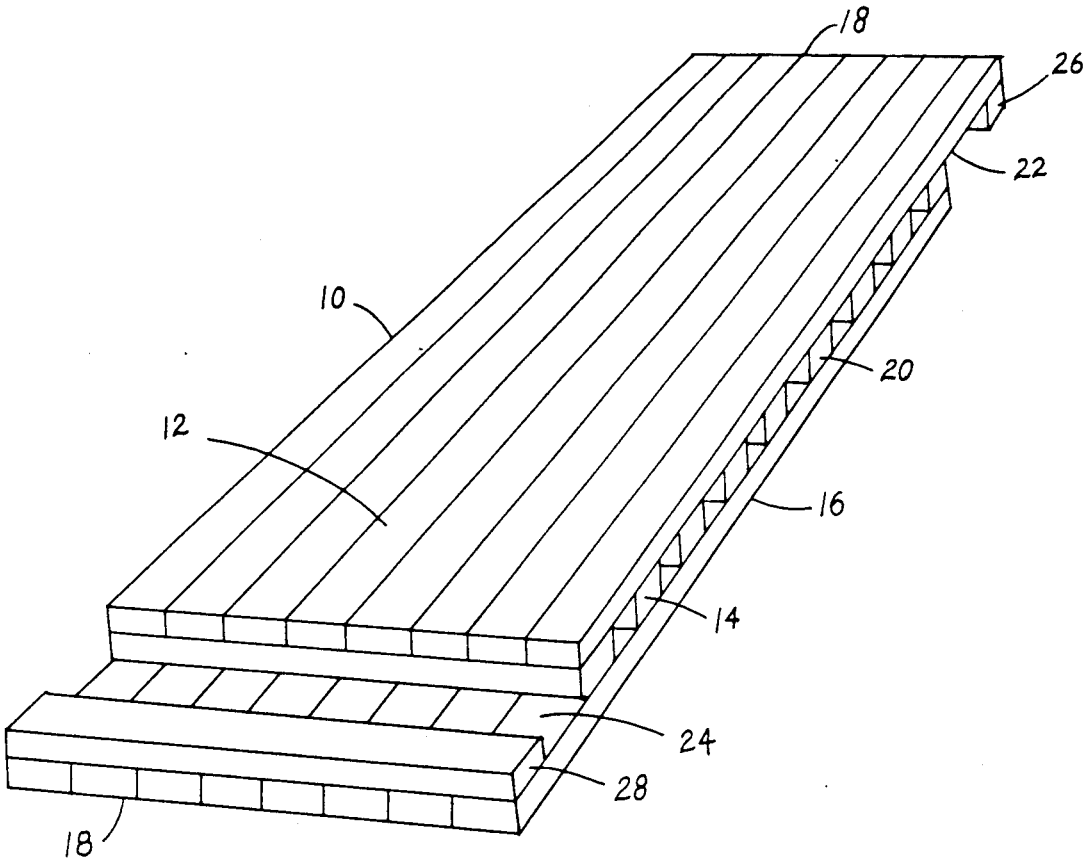
FIG. 1 is a perspective view of a temporary mat apparatus built according to the present invention.

Referring now to the drawings and more particularly to FIG. 1, a temporary mat 10 is shown in perspective. The rectangular mat is comprised of three layers of wooden boards, a first longitudinal layer 12, an intermediate transverse layer 14, and a second longitudinal layer 16. The boards are fastened together by spikes, nails, bolts or other fastening means to form a mat.

The first longitudinal layer 12 and second longitudinal layer 16 are comprised of a plurality of boards 18 of the same length placed side by side in a manner so as to form a uniform bearing surface. The intermediate transverse layer 14 is comprised of a plurality of boards 20 of the same length as the width of the longitudinal layers 12 and 16. The boards 20 are placed transversely to the longitudinal boards 18 in such number, manner and spacing as necessary to provide sufficient mat stability and strength to adequately transfer loading between the first and second longitudinal layers 12 and 16 and to separate the first longitudinal layer 12 from the second longitudinal layer 16.

The ends of the first longitudinal layer 12 arm offset with respect to the ends of the second longitudinal layer 16 and when coupled with an upper transverse end board 26 and a lower transverse end board 28, form an upper notch or lip 22 and a lower notch or lip 24 at opposite ends of the mat 10. The transverse end boards 26 and 28 are the same size as the transverse boards 20 of the transverse layer 14.

A plurality of adjoining temporary mats 10 as described are employed when constructing a temporary road or work surface. The mats are joined together by laying down a first mat 10 as a starting point with its lower lip 24 exposed. The upper lip 22 of a second mat 10 is then laid over the lower lip 24 of the first mat 10 and thereby interlocking the first and second mats 10 together.

Figure 2:
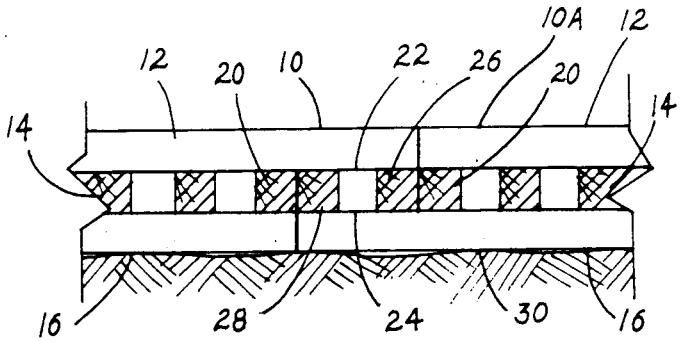
FIG. 2 is a partial cross-section view at abutting ends of adjacent interlocking individual mats.

FIG. 2, a partial cross-section through the ends of adjoining identical mats, designated 10 and 10A for illustration, shows the manner in which the individual mats are interlocked with each other on the ground 30. The upper lip 22 of mat 10 is shown overlaying and interlocked with the lower lip 24 of the adjoining mat 10A. Mats 10 and 10A are identical and are interlocked merely by orienting the upper lip 22 of mat 10 over the lower lip 24 of mat 10A and dropping the mat 10 in place. The upper transverse end board 26 and the lower transverse end board 28 join with the boards 20 the intermediate transverse layer 14 to transfer loads between the longitudinal layers 12 and 16. This establishes the continuity of the three ply matting system in a single operation without the use of nails or other fasteners to keep the mats in place. In construction a crane, a forklift or other lifting means can be used to place the mats.

Figure 3:
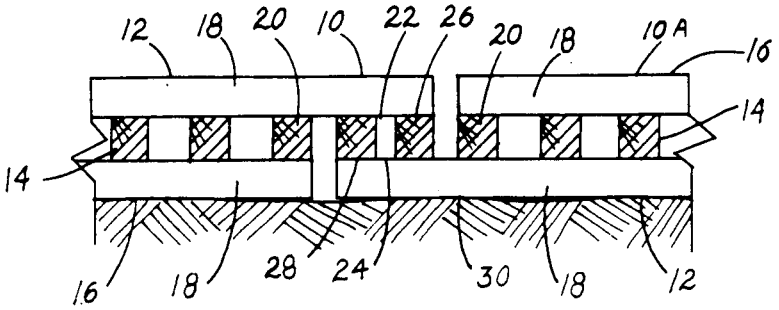
FIG. 3 is an alternate partial cross-section view at abutting ends of adjacent interlocking individual mats.

FIG. 3 shows another typical partial cross-section through adjoining identical mats 10 and 10A on a ground surface 30. This figure illustrates the tolerance or play available in the interlocking of the upper lip 22 and lower lip 24. The length of the upper lip 22 and lower lip 24 is dependent on the amount of offset of the first 12 and second 16 longitudinal layers. The offset should be of sufficient length to allow easy overlaying of the transverse end boards 26 and 28 of the upper and lower lips. The upper lip 22 of mat 10 is shown in place over the lower lip 24 of mat 10A. The longitudinal boards 18 of mat 1 need not abut the longitudinal boards 18 of mat 10A for the mats to function as a unit. This play allows for ease of construction when the mats are assembled to for a working surface.

FIG. 3 further illustrates the components of the identical mats 10 and 10A showing the first longitudinal layer 12 and the second longitudinal layer 16 both comprised of a plurality of transverse boards 14. The upper lip 22 of mat 10 is formed by the upper offset of the ends of the boards 18 of the first longitudinal layer 12 with respect to the second longitudinal layer 16 coupled with the upper transverse end board 28. The lower lip of mat 10A is formed by the lower offset of the first longitudinal layer 12 with respect to the second longitudinal layer 16 and the lower transverse end board 26. The offset is of sufficient length to allow the transverse end boards 26 and 28 to fit in the space created by the offset. When the upper lip 22 of the first mat 10 is overlaid onto the lower lip 24 of the second mat 10A, the continuity of adjacent three layer mats is completed.

Figure 4:
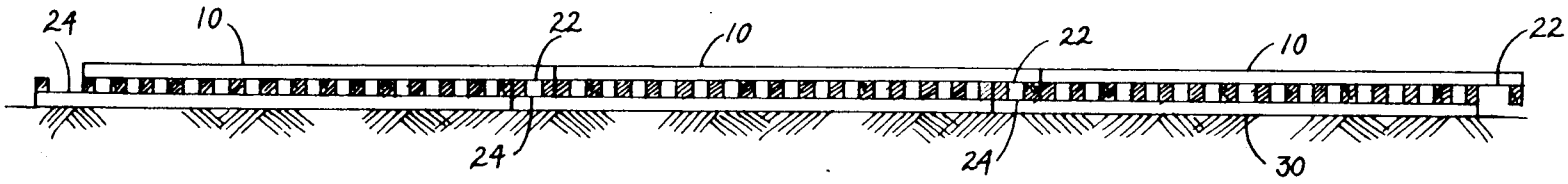
FIG. 4 is a cross-section view of interlocking adjacent mats of the claimed invention illustrating how the mats are placed to form the matting system.

FIG. 4 shows a cross-section view of a matting system constructed with a plurality of identical mats 10. Working from right to left as illustrated, a first mat 10 is laid down on the ground area 30 to be covered so as to expose on the left side the lower lip 24 of the first mat 10. A second mat 10 is laid down with its upper lip 22 overlaying and interlocking with the lower lip 24 of the first mat 10 and exposing the lower lip 24 of the second mat 10. A third mat 10 is then laid down with its upper lip 22 overlaying and interlocking with the lower lip 24 of the second mat 10 and exposing the lower lip 24 of the third mat 10. A plurality of mats 10 can be laid in the manner illustrated to construct a temporary road or work surface of interlocking mats.

Figure 5:
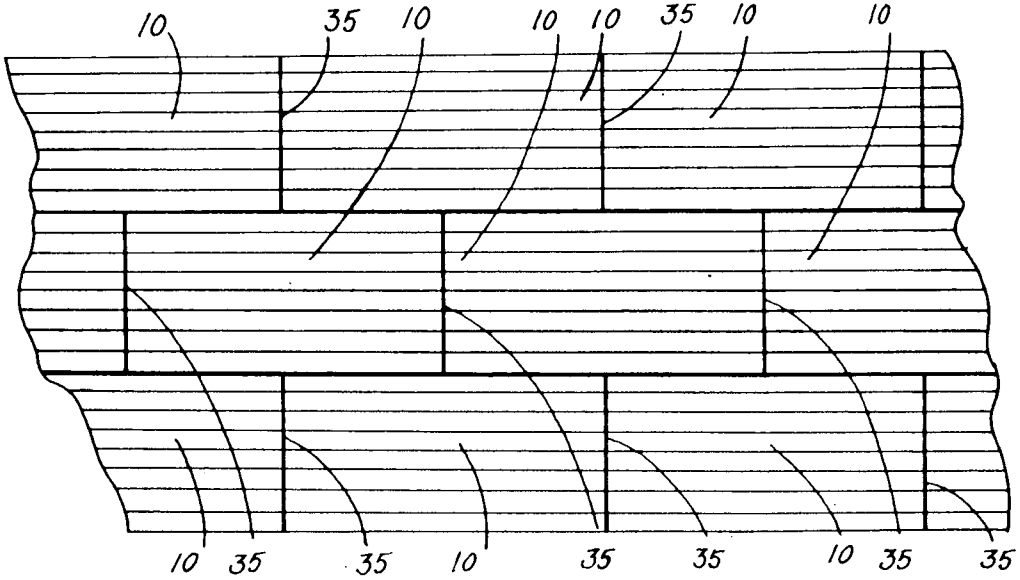
FIG. 5 is a plan view of a matting system constructed with the present invention.

FIG. 5 shows a plan view of a matting system constructed by the method and apparatus described above. Abutting rows of mats 10 are laid down side by side over the ground to be covered to form the work surface or access road. The seams 35 where the adjoining mats 10 overlap and interlock with each other can be staggered as shown when the rows of abutting mats are placed in order to achieve mat system stability. This may or may not be necessary depending upon the actual soil conditions present at the construction site where the invention is used.

It is understood that the temporary mat and the matting system described can be utilized on any area of poor soil condition where temporary roads and work areas are desired.

It is further understood that the mats 10 are to be constructed from wooden boards but the form and shape which give the mats their unique qualities could be incorporated into mats of other materials with the same claimed advantages.

It is thought that the mat and matting system and many of its intended advantages will be understood from the foregoing description and it will be apparent that various changes may be made in form, construction, and arrangement of the parts thereof without departing from the spirit and scope of the invention or sacrificing all of its material advantages, the form herein before described being merely illustrative of the preferred embodiment of the invention.

I claim:

1. A three ply mat for constructing temporary roads and work areas, comprising:

(a) an upper ply of boards situated so as to form a first rectangular bearing surface;

(b) a lower ply of boards substantially the same as said upper ply situated so as to form a second rectangular bearing surface;

(c) an intermediate ply of boards situated between said upper ply and said lower ply separating spacedly said upper ply from said lower ply; and (d) an upper L-shaped lip at one longitudinal end of said upper ply and a lower opposing L-shaped lip at the opposite longitudinal end of said lower ply.

2. A mat as recited in claim 1 wherein a plurality of said mats are arranged in sequence adjacent to one another by placing the upper L-shaped lip of succeeding mats over the lower L-shaped lip of the preceding adjacent mat so as to lock said mats together.

3. A mat as recited in claim 1 wherein said mat is made of wood.

4. A three layer rectangular mat for constructing temporary roads and work surfaces comprising:

(a) an upper layer of longitudinal boards;

(b) a lower layer of longitudinal boards of substantially the same size and number as said upper layer of longitudinal boards, said upper layer of longitudinal boards being offset longitudinally with respect to said lower layer of longitudinal boards so as to form an upper overhanging offset and a lower underhanging offset at opposite ends of said mat, each offset having an inside edge and an outside edge;

(c) an upper transverse end board at the outside edge of said upper overhanging offset, the length of said upper overhanging offset being at least twice the width of said upper transverse end board, so as to form an upper L-shaped lip at the upper overhanging offset end of said mat;

(d) a lower transverse end board of substantially the same dimensions as said upper transverse end board at the outside edge of said lower underhanging offset, the length of said lower underhanging offset being at least twice the width of said lower transverse end board, so as to form an opposing lower L-shaped lip at the lower underhanging offset end of said mat; and (e) an intermediate layer of transverse boards interposed between said upper and said lower layers, the boards of said intermediate layer being located between the inside edge of said upper overhanging offset and the inside edge of said lower underhanging offset so as to separate spacedly said upper and said lower layers and tie them together.

5. A mat as recited in claim 4 wherein the length of said upper overhanging offset and said lower underhanging offset are at least three times the width of said transverse end boards.

6. A mat as recited in claim 4 wherein said mat is made of wood.

7. A mat as recited in claim 4 wherein a plurality of said mats are arranged adjacent to one another, upper overhanging offset to lower underhanging offset, so that adjoining L-shaped upper and lower lips are placed, upper lip over lower lip, so as to interlock said mats together.

8. A rectangular mat section for constructing temporary roads and work surfaces comprising:

(a) an upper layer consisting of a plurality of longitudinal boards having substantially the same cross-sectional dimensions and length spaced so as to form a uniform bearing area;

(b) a lower layer consisting of a plurality of longitudinal boards of substantially the same number and size and spaced in substantially the same manner as the boards of said upper longitudinal layer, the ends of the boards of said upper layer being offset with respect to the ends of the boards of said lower layer so as to form an upper offset, said upper offset having an inside and an outside edge, and a lower offset, said lower offset having an inside and an outside edge, at opposite ends of said mat;

(c) an upper transverse end board substantially flush with said outside edge of said upper offset and below said longitudinal boards of said upper layer so as to form an L-shaped upper lip with said upper offset;

(d) a lower transverse end board substantially flush with said outside edge of said lower offset and of substantially the same dimensions as said upper transverse end board above said longitudinal boards of said lower layer so as to form an L-shaped lower lip with said lower offset, the length of said upper and said lower offsets being at least twice the width of said transverse end boards; and (e) an intermediate layer consisting of a plurality of transverse boards of substantially the same cross-sectional dimensions and length wherein said transverse boards are located between the inside edge of said upper offset and the inside edge of said lower offset so as to separate spacedly said upper layer from said lower layer and to transfer loading between said upper and lower layers.

9. A mat as recited in claim 8 wherein the length of said upper and said lower offsets are at least three times the width of said transverse end boards.

10. A mat as recited in claim 8 wherein said mat is made of wood.

11. A method of constructing temporary roads and work surfaces over areas of poor ground soil condition with a lifting means comprising the steps of:

(a) providing a plurality of three ply wood mats having opposing upper and lower L-shaped lips at opposite ends;

(b) lifting a first three ply mat and laying it over the ground area to be covered exposing said lower L-shaped lip of said first mat;

(c) lifting a second three ply mat and laying it over the ground area to be covered with said upper L-shaped lip of said second mat overlaying and coupled with said lower L-shaped lip of said first mat interlocking said first and second mats together; and (d) repeating the steps of lifting and laying additional three ply mats, said upper L-shaped lip of each succeeding mat overlaying and coupling with said lower L-shaped lip of the preceding mat, until the desired amount of mating is laid.

12. A temporary mat system to provide access and coverage over areas of poor ground soil condition, said mat system comprising:

(a) a plurality of three ply mats, each of said mats having an upper layer consisting of a plurality of longitudinal boards having substantially the same cross-sectional dimensions and length spaced so as to form a uniform bearing area, a lower layer consisting of a plurality of longitudinal boards of substantially the same number and size and spaced in substantially the same manner as the boards of said upper longitudinal layer, the ends of the boards of said upper layer being offset with respect to the ends of the boards of said lower layer so as to form an upper offset, said upper offset having an inside and an outside edge, and a lower offset, said lower offset having an inside and an outside edge, at opposite ends of said mat, an upper transverse end board substantially flush with said outside edge of said upper offset and below said longitudinal boards of said upper layer so as to form an L-shaped upper lip with said upper off-set, a lower transverse end board substantially flush with said outside edge of said lower offset and of substantially the same dimensions as said upper transverse end boards above said longitudinal boards of said lower layer so as to form an L-shaped lower lip with said lower offset, the length of said upper and said lower offsets being at least twice the width of said lower transverse end board, so as to form an opposing lower L-shaped lip at the lower underhanging offset end of said mat, an intermediate layer of transverse boards interposed between said upper and said lower layers, the boards of said intermediate layer being located between the inside edge of said upper overhanging offset and the inside edge of said lower underhanging offset so as to separate spacedly said upper and said lower layers and tie them together, said mats being positioned in abutting rows so that said rows of said mats are laid over the ground to be covered with a first mat in each of said rows laid down so as to expose said lower L-shaped lip of said first mat in each of said rows in the direction in which coverage is desired, with a second mat in each of said rows laid down over the ground to be covered with said upper L-shaped lip of said second mat in each of said rows overlaying and coupled with said lower L-shaped lip of said first mat in each of said rows so as to interlock said second mat together with said second mat in each of said rows; and (b) a plurality of additional said three ply mats as needed to cover the required ground area, said additional mats laid so that said upper L-shaped lip of each said additional mat is overlaying and coupled with said lower L-shaped lip of each preceding mat so as to interlock said additional mats with said preceding mats.

13. A mat system as recited in claim 12 wherein said rows of interlocking mats are laid one row at a time, the junction of each mat in each subsequent row being staggered with respect to the junction of each mat in the abutting preceding row.

* * * * *